US011889926B1

(12) United States Patent
Leng

(10) Patent No.: US 11,889,926 B1
(45) Date of Patent: Feb. 6, 2024

(54) ELASTIC MODULE UNIT, ELASTIC PAD AND FURNITURE

(71) Applicant: NEW-TEC INTEGRATION (XIAMEN) CO., LTD., Xiamen (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 18/179,932

(22) Filed: Mar. 7, 2023

(30) Foreign Application Priority Data

Oct. 24, 2022 (CN) ..... 202211308106.9

(51) Int. Cl.
*A47C 27/07* (2006.01)
*A47C 27/06* (2006.01)

(52) U.S. Cl.
CPC ..... *A47C 27/07* (2013.01); *A47C 27/063* (2013.01)

(58) Field of Classification Search
CPC ..... A47C 27/07; A47C 27/06; A47C 27/063
See application file for complete search history.

(56) References Cited

U.S. PATENT DOCUMENTS 5,768,726 A 6/1998 Myles
5,957,438 A * 9/1999 Workman ..... B68G 9/00 5/655.8
5,970,547 A 10/1999 Cavazos
10,869,559 B2 12/2020 Leng
2008/0184492 A1* 8/2008 Sunde ..... A47C 27/15 5/717
2013/0075574 A1 3/2013 Ferraiolo
2017/0043338 A1 2/2017 Tan et al.
2017/0340129 A1 11/2017 Leng
2018/0027976 A1 2/2018 Leng
2019/0090652 A1 3/2019 Leng
2021/0037988 A1 2/2021 Leng

FOREIGN PATENT DOCUMENTS

CN 104643727 A 5/2015
CN 106820767 A 6/2017
CN 106880220 A 6/2017
CN 207220572 U 4/2018
CN 207285726 U 5/2018
(Continued)

OTHER PUBLICATIONS

Chinese Patent No. CN 112674541 published on Apr. 20, 2021.*
(Continued)

*Primary Examiner* — Pamela Rodriguez
(74) *Attorney, Agent, or Firm* — Perkins Coie LLP

(57) ABSTRACT

An elastic module unit for a pad or furniture may include a fixed bottom plate and a plurality of elastic modules disposed on the fixed bottom plate, the fixed bottom plate including splicing sides arranged opposite to each other and end sides arranged opposite to each other. Each of the end sides includes a plurality of connectors having a rotary detent member and/or an engagement member. The rotary detent member is configured to swing about a pivot axis so that it releasably engages an engagement member of an adjacent elastic module unit. The engagement member is configured to releasably engage a rotary engagement member of an adjacent elastic module unit.

22 Claims, 10 Drawing Sheets

(56) References Cited

FOREIGN PATENT DOCUMENTS

| | | | |
|---|---|---|---|
| CN | 208988046 | U | 6/2019 |
| CN | 209289229 | U | 8/2019 |
| CN | 112237344 | A | 1/2021 |
| CN | 212438015 | U | 2/2021 |
| CN | 212465507 | U | 2/2021 |
| CN | 112674537 | A | 4/2021 |
| CN | 215533110 | U | 1/2022 |
| CN | 216059947 | U | 3/2022 |
| CN | 115191785 | A | 10/2022 |
| CN | 217743729 | U | 11/2022 |
| DE | 20209100 | U1 | 7/2003 |
| DE | 102005026058 | A1 | 4/2006 |
| DE | 202005010441 | U1 | 8/2006 |
| FR | WO-2005/084495 | A1 * | 9/2005 |
| GB | 2607718 | A | 12/2022 |
| WO | 2021073598 | A1 | 4/2021 |

OTHER PUBLICATIONS

Translation of Chinese Patent No. 112674541 obtained from website: https://worldwide.espacenet.com on Jun. 6, 2023.*
International Search Report for International Application No. PCT/CN2022/141138; dated Jul. 20, 2023; 5 pages.
Search Report for United Kingdom Application No. GB2303447.3; dated May 5, 2023; 4 pages.
Extended European Search Report for European Application No. 23160915.7; dated Aug. 21, 2023; 7 pages.
Office Action in German Application No. 102023108695.2; dated Oct. 6, 2023; 10 pages.

* cited by examiner

ELASTIC MODULE UNIT, ELASTIC PAD AND FURNITURE

TECHNICAL FIELD

The present disclosure relates to the field of elastic pads, in particular to an elastic module unit, an elastic pad and a furniture.

BACKGROUND

Furniture such as beddings and sofa beds are essentials in daily life. Most existing beddings and sofa beds are provided with elastic pads. Such elastic pads are resilient, which can provide an elastic support when a person is lying on the bedding and the sofa bed. Thus, an elastic pad is more comfortable than a hard pad.

Existing elastic pads are typically a one-piece, non-detachable, enclosed pad consisting of an integral bottom layer, a spring layer, a sponge overlay and enclosed sides, i.e., the spring layer is disposed on the bottom layer, the sponge overlay is disposed on the spring layer, and the enclosed sides are connected between the sponge overlay and the bottom layer, to form a closed space.

However, these types of elastic pads generally exhibit poor performance in comfort. They can also be expensive, and have poor stability in actual use, such that comfort is deteriorated. These types of elastic pads can also be inconvenient to transport and take up a large space when stored.

SUMMARY

In view of at least some problems existing in the prior art, the objective of the present disclosure is to improve the convenience in assembling an elastic pad, to effectively reduce the occupied space when storing the elastic pad.

In order to fulfil the above objective, in a first aspect, an elastic module unit is configured to be assembled into an elastic pad, the elastic module unit comprises a fixed bottom plate and a plurality of elastic modules disposed on the fixed bottom plate, the fixed bottom plate comprises splicing sides arranged opposite to each other and end sides arranged opposite to each other, and each of the end sides comprises a plurality of connectors. The plurality of connectors comprise at least one of a rotary detent member and an engagement member, wherein the rotary detent member is configured to swing about a pivot axis so that it releasably engages an engagement member of an adjacent elastic module unit; and the engagement member is configured to releasably engage a rotary detent member of an adjacent elastic module unit.

In the technical solution, the fixed bottom plate comprises end sides arranged opposite to each other, each end side comprises a plurality of connectors, the plurality of connectors comprise at least one of the rotary detent member and the engagement member, the rotary detent member is configured to swing about a pivot axis so that it releasably engages an engagement member of an adjacent elastic module unit. The engagement member is configured to releasably engage a rotary detent member of an adjacent elastic module unit. When the elastic module units are assembled into the elastic pad, splicing sides of a plurality of fixed bottom plates are spliced sequentially, and the adjacent fixed bottom plates are connected by engagement of the rotary detent member and the engagement member of the two adjacent fixed bottom plates. In this way, all the fixed bottom plates can be spliced by engagement of the rotary detent member and the engagement member so that a plurality of elastic module units can be assembled into an elastic support layer of the elastic pad. Therefore, the elastic module units can significantly improve the convenience in assembling the elastic pad, and can facilitate detachment for storage, thereby effectively reducing the storage space of the elastic pad.

In some embodiments, one of the plurality of connectors is disposed at a corner of each of the end sides.

In some embodiments, each of the end sides is provided with the rotary detent member and the engagement member.

In some embodiments, the rotary detent members on the two end sides arranged opposite to each other are located on one diagonal of the elastic module unit while the engagement members on the two end sides arranged opposite to each other are located on the another diagonal of the elastic module unit, and the rotation direction of the rotary detent members are identical.

In some embodiments, the engagement member comprises a snap-in post.

In some embodiments, a receiving groove configured to receive the connectors is formed on a circumferential side surface at each corner of the fixed bottom plate.

In some embodiments, an operating opening for enabling a user to apply a force to rotate the rotary detent member is formed on an upper groove wall of the receiving groove.

In some embodiments, the rotary detent member comprises a detent hook and a peg, the detent hook being configured to be releasably snapped to the engagement member of the adjacent elastic module unit, wherein the rotary engagement member has a storage position where the peg is located within the receiving groove and a part of the detent hook extends laterally from the receiving groove, and an engagement position where the detent hook is located in the receiving groove of the adjacent elastic module unit and a part of the peg extends laterally from the receiving groove of the adjacent elastic module unit.

In some embodiments, the rotary detent member is configured to hook a connection rope fixed on a pad layer of the elastic pad.

In some embodiments, the rotary detent member comprises a detent hook and a peg, the detent hook being configured to be releasably snapped to the engagement member of the adjacent elastic module unit; wherein the rotary detent member has a storage position where the peg is located within the receiving groove and the detent hook is configured to hook the connection rope, and an engagement position where the detent hook is located within the receiving groove of the adjacent elastic module unit and the peg is configured to hook the connection rope.

In some embodiments, each of the splicing sides is formed to have a pre-positioning structure, which is configured to engage with a pre-positioning structure formed on a splicing side of a fixed bottom plate of an adjacent elastic module unit.

In some embodiments, the pre-positioning structure comprises a first pre-positioning structure and a second pre-positioning structure arranged at an interval in an extending direction of the splicing sides, the second pre-positioning structure being different from the first pre-positioning structure; wherein the first pre-positioning structure is configured to engage with a second pre-positioning structure of an adjacent elastic module unit, and the second pre-positioning structure is configured to engage with a first pre-positioning structure of an adjacent elastic module unit.

In some embodiments, the first pre-positioning structure located at one side of the elastic module unit and the second pre-positioning structure located at the other side are aligned with each other along a transverse direction of the elastic module unit, and the second pre-positioning structure located at one side of the elastic module unit and the first pre-positioning structure located at the other side are aligned with each other along the transverse direction of the elastic module unit.

In some embodiments, the first pre-positioning structure is a pre-positioning bump, and the second pre-positioning structure is a pre-positioning groove.

In a second aspect, the present disclosure provides an elastic pad, comprising: a plurality of elastic module units any described above in the first aspect, a plurality of the fixed bottom plates being spliced together by engagement of the rotary detent member and the engagement member so that the plurality of the elastic module units are assembled into an elastic support layer; and a pad layer laid on a plurality of the elastic modules of the elastic support layer.

As described above, the plurality of fixed bottom plates can be spliced together by engagement of the rotary detent member and the engagement member so that the plurality of elastic module units can be assembled into the elastic support layer of the elastic pad. This can significantly improve the convenience in assembling the elastic pad, and can facilitate detachment for storage, thereby effectively reducing the storage space of the elastic pad.

In some embodiments, the elastic pad further comprises a cover, wherein the cover covers the pad layer and is connected with the spliced fixed bottom plates via an edge connection structure which enables the elastic pad to form an elastic pad without enclosed sides surrounding the cover.

In some embodiments, the edge connection structure comprises a connection rope, and when the rotary detent member comprises a detent hook and a peg, the detent hook of the rotary detent member in a storage position releasably hooks a corresponding connection rope, and the peg of the rotary detent member in an engagement position releasably hooks a corresponding connection rope.

In some embodiments, at least two sides of the cover arranged opposite to each other are provided with stop edges facing the fixed bottom plates, and at least two stop edges arranged opposite to each other in the stop edges are connected with the spliced fixed bottom plates via the edge connection structure.

In some embodiments, the stop edge extends to a position where is close to the fixed bottom plate and is kept a predetermined interval from the fixed bottom plate so that the stop edge shields the elastic module.

In some embodiments, the elastic pad is used as an elastic mattress.

In the third aspect, the present disclosure provides a furniture comprising any elastic pad as described above in the second aspect.

In addition, the furniture includes, but is not limited to, beds, sofas, chairs, sofa beds, upholstered benches, and the like.

Elements or features described above in a single embodiment may be used, alone or in combination, in other embodiments.

BRIEF DESCRIPTION OF THE DRAWINGS

Dimensions and proportions in the drawings do not represent the dimensions and proportions of actual products. The drawings are provided only illustratively, and some unnecessary elements or features are omitted therefrom for clarity.

REFERENCE SIGNS

Figure 1:
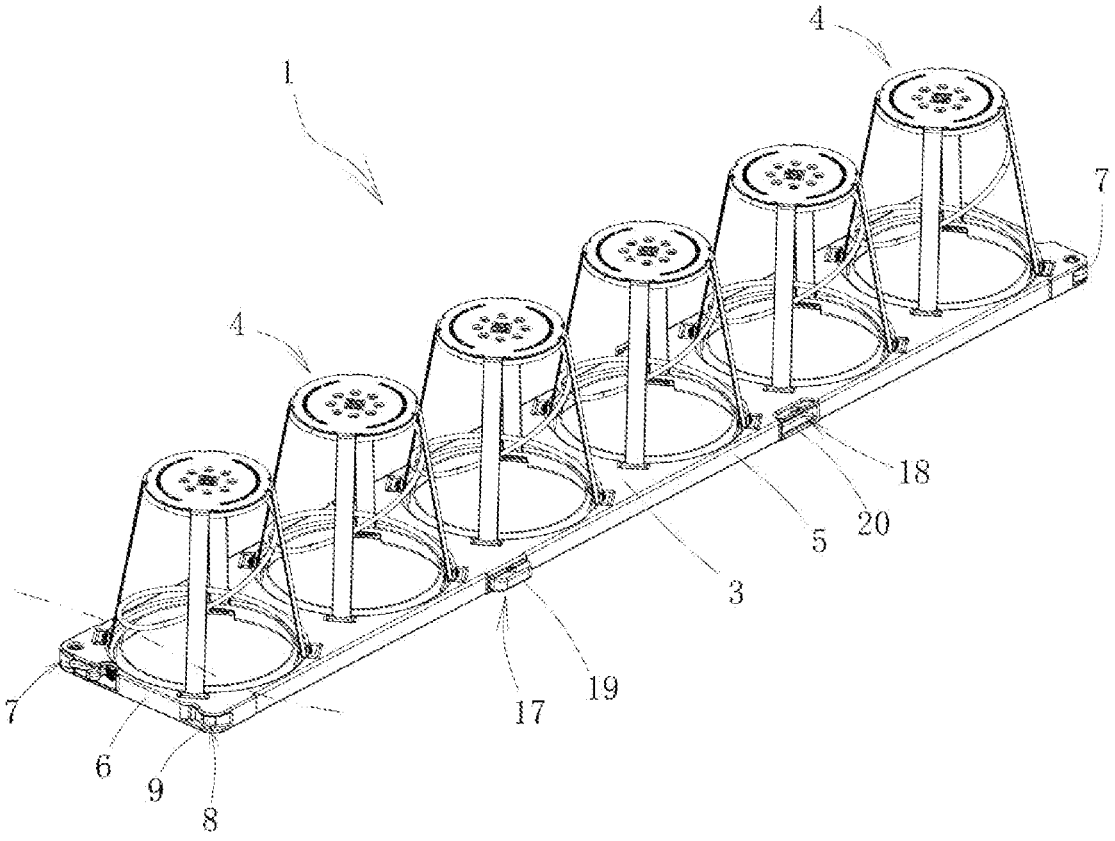
FIG. 1 is a schematic diagram exemplarily illustrating a three-dimensional structure of a first type of elastic module unit according to the present disclosure, where a rotary detent member is at a storage position.

1—elastic module unit, 2—elastic pad, 3—fixed bottom plate, 4—elastic module, 5—splicing side, 6—end side, 7—rotary detent member, 8—engagement member, 9—snap-in post, 10—receiving groove, 11—upper groove wall, 12—operating opening, 13—detent hook, 14—peg, 15—pad layer, 16—connection rope, 17—first pre-positioning structure, 18—second pre-positioning structure, 19—pre-positioning bump, 20—pre-positioning groove, 21—elastic support layer, 22—cover, 23—stop edge.

DETAILED DESCRIPTION OF EMBODIMENTS

Reference now will be made to the drawings to describe in detail the elastic module unit, elastic pad and furniture. What will be described herein will only cover preferred embodiments of the present disclosure, and those skilled in the art would envision, on the basis of the preferred embodiments, other possible manners which also fall into the scope described herein.

In a first aspect, an elastic module unit 1 according to the present disclosure is configured to be assembled into an elastic pad 2 which may be used to manufacture a household item, for example. Referring to FIGS. 1-8, the elastic module unit 1 comprises a fixed bottom plate 3 and a plurality of elastic modules 4 disposed on the fixed bottom plate 3. The fixed bottom plate 3 comprises splicing sides 5 arranged opposite to each other and end sides 6 arranged opposite to each other. Each end side 6 includes a plurality of connectors. The plurality of connectors include at least one of a rotary detent member 7 and an engagement member 8, where the rotary detent member 7 is configured to swing about a pivot axis so that it releasably engages an engagement member 8 of an adjacent elastic module unit 1, and the engagement member 8 is configured to releasably engage a rotary detent member 7 of an adjacent elastic module unit 1.

In the elastic module unit 1, the fixed bottom plate 3 comprises end sides 6 arranged opposite to each other, each end side 6 includes a plurality of connectors, the plurality of connectors comprise at least one of the rotary detent member 7 and the engagement member 8, the rotary detent member 7 is configured to swing about a pivot axis so that it releasably engages an engagement member 8 of an adjacent elastic module unit 1, and the engagement member 8 is configured to releasably engage a rotary detent member 7 of an adjacent elastic module unit 1. In the circumstance, when the elastic module units 1 are assembled into the elastic pad 2, splicing sides 5 of a plurality of fixed bottom plates 3 are spliced sequentially, and the adjacent bottom fixed bottom plates 3 are connected by engagement of the rotary detent member 7 and the engagement member 8 of the two adjacent fixed bottom plates. In this way, all the fixed bottom plates 3 can be spliced by engagement of the rotary detent member 7 and the engagement member 8 so that a plurality of elastic module units 1 can be assembled into an elastic support layer 21 of the elastic pad 2. Therefore, the elastic module units 1 can significantly improve the convenience in assembling of the elastic pad 2, and can facilitate detachment for storage, thereby effectively reducing the storage space of the elastic pad.

It is worth noting that the elastic module unit 1 according to the present disclosure may be of multiple types. For example, for a first type of elastic module unit 1, some elastic module units 1 where end sides 6 of fixed bottom plates 3 include a plurality of rotary detent members 7 are used as a first elastic module unit, and some other elastic module units 1 where end sides 6 of fixed bottom plates 3 include a plurality of engagement members 8 are used as a second elastic module unit. As such, the plurality of engagement members 8 of the second elastic module unit can engage rotary detent members 7 of a preceding adjacent first elastic module unit and rotary detent members 7 of a following first elastic module unit, and so on. Accordingly, a plurality of elastic module units 1 can be assembled together.

For another example, for a second type of elastic module unit 1, referring to FIGS. 1-7, each end side 6 of the fixed bottom plate 3 of the elastic module unit 1 is provided with a rotary detent member 7 and an engagement member 8. In the circumstance, a rotary detent member 7 of an elastic module unit 1 engages an engagement member 8 of a preceding adjacent elastic module 1, and an engagement member 8 of the elastic module unit 1 engages a rotary detent member 7 of a following adjacent elastic module unit 1, and so on. Therefore, a plurality of elastic module units 1 can be assembled together.

The connectors may be disposed at any position of the end side 6. For example, in some embodiments, connectors may be disposed at the middle position of the end side 6, or may be disposed at other position of the end side 6 close to the middle position. For another example, in some other embodiments, referring to FIG. 6, the corners of each end side 6 are respectively provided with connectors, for example, one of the plurality of connectors is disposed at a corner of each of the end sides 6. In this way, this can make full use of the corner of the end side 6 for arrangement of connectors, and facilitate a connection between adjacent fixed bottom plates 3.

As described above, in the second type of elastic module unit 1, the end side 6 of the fixed bottom plate 3 of the elastic module unit 1 includes a rotary detent member 7 and an engagement member 8. Therefore, in some embodiments, referring to FIG. 6, each of the end sides is provided with the rotary detent member and the engagement member, for example, the corners of each end side 6 are respectively provided with a rotary detent member 7 and an engagement member 8.

Figure 6:
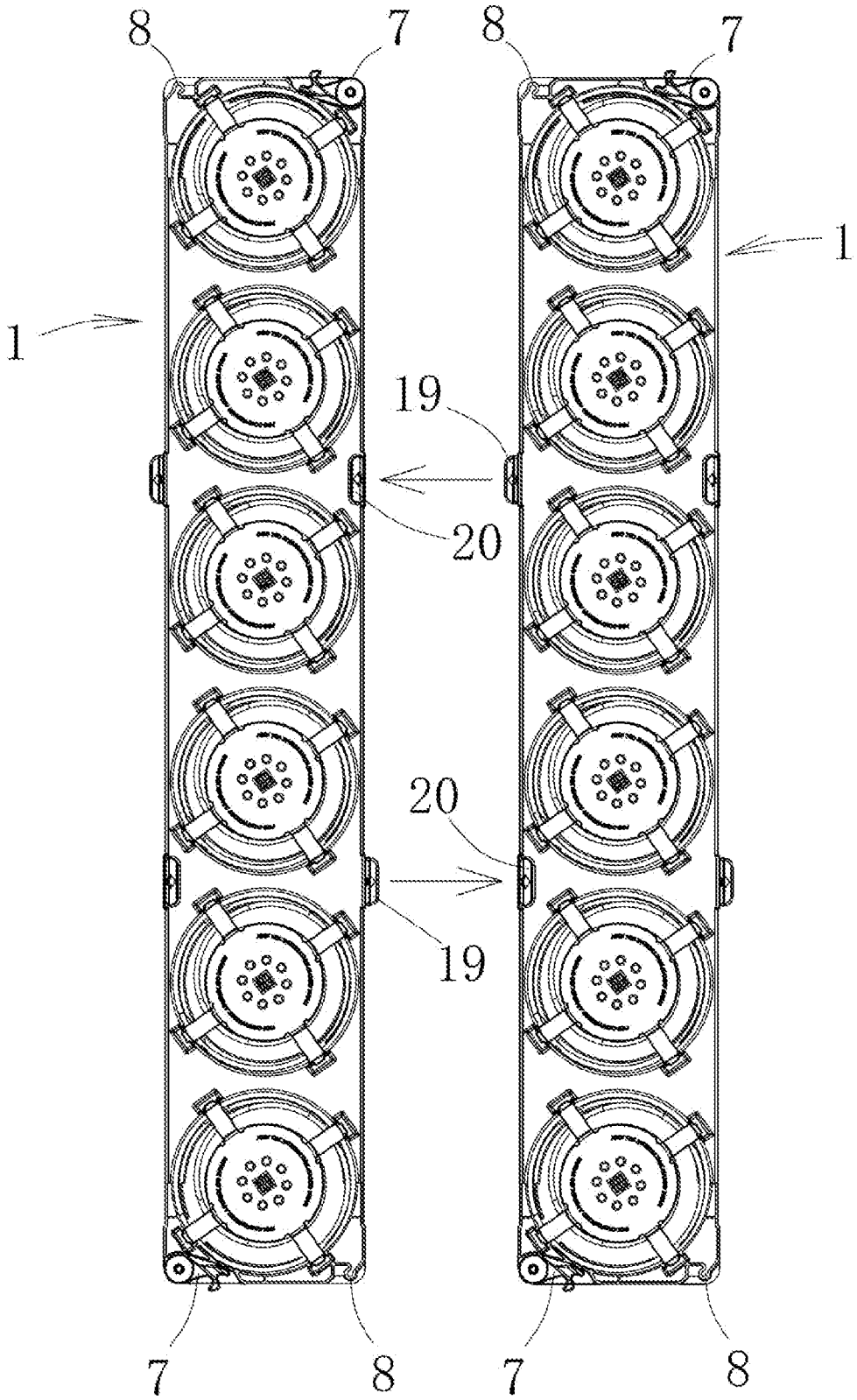
FIG. 6 is a schematic diagram of a structure where two second type of elastic module units according to the present disclosure are spliced.
Figure 7:
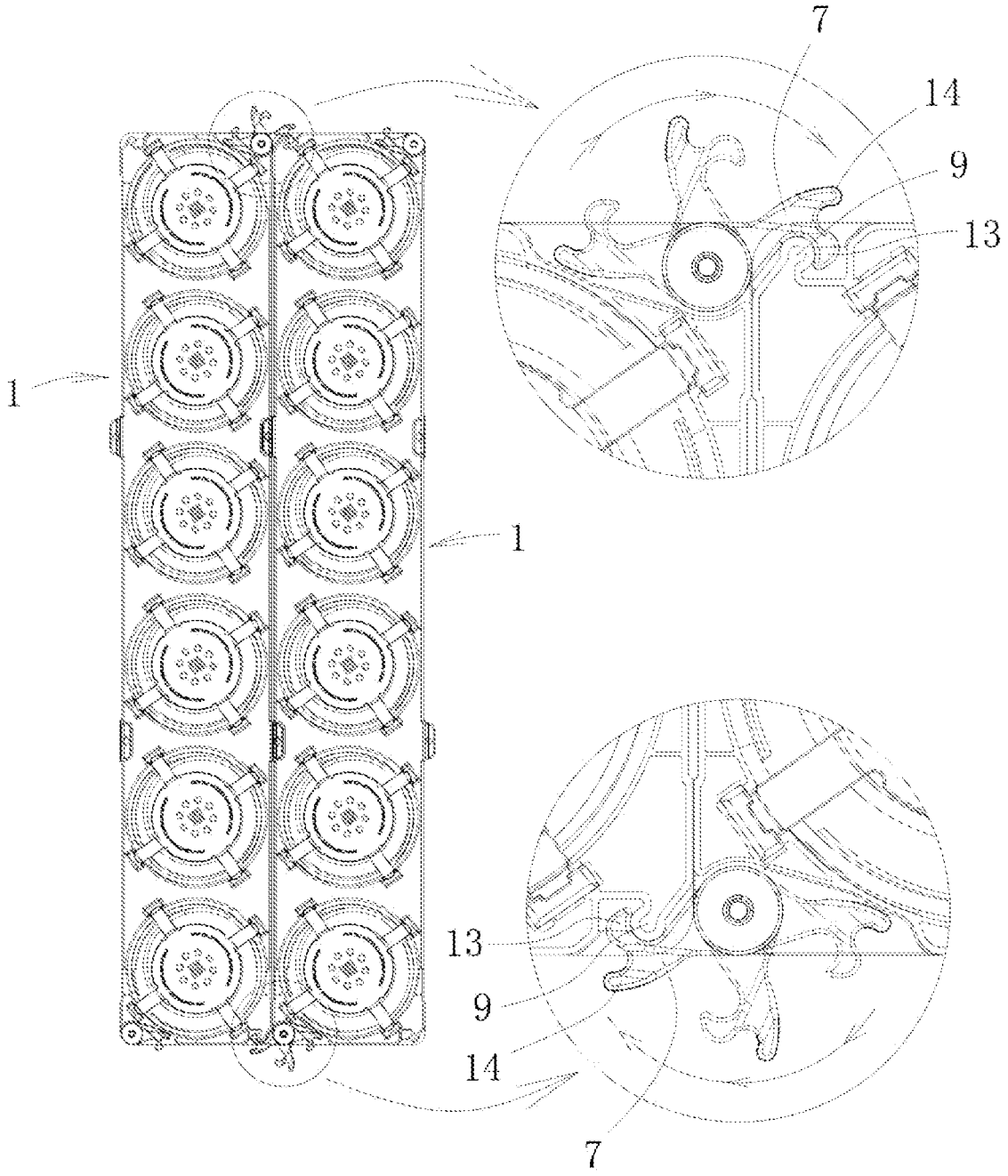
FIG. 7 is a schematic diagram of a structure where the two elastic module units in FIG. 6 are in engagement positions, in which two rotary detent members represented by dotted lines indicate the swing positions of the rotary detent members.
Figure 8:
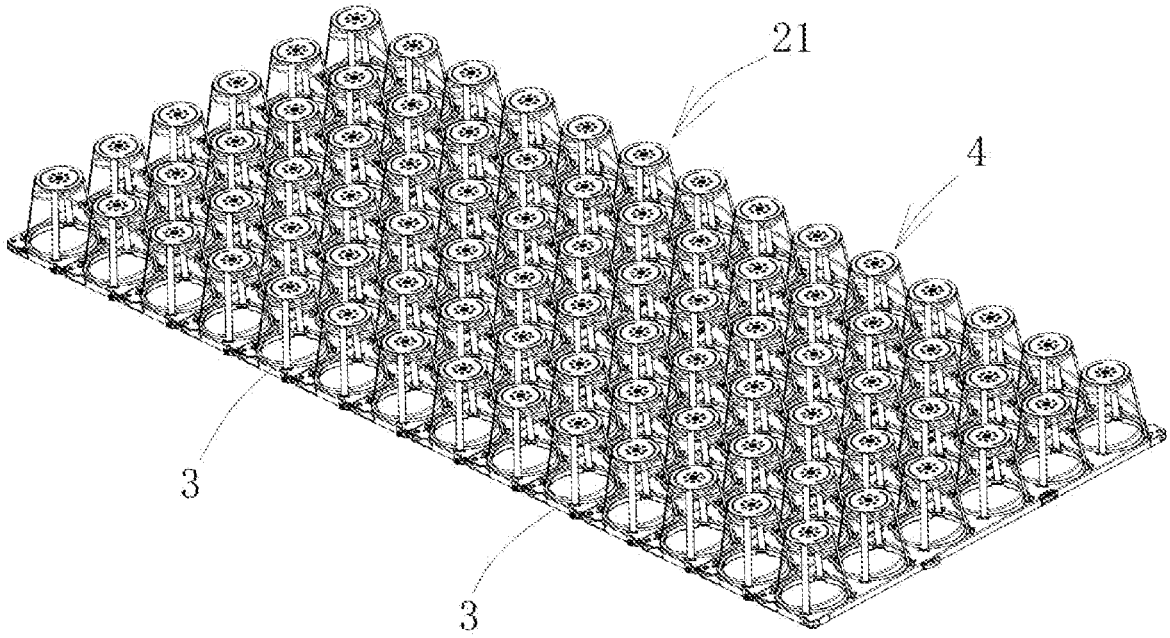
FIG. 8 is a schematic diagram of a structure where a plurality of elastic module units are spliced into an elastic support layer of an elastic pad in the splicing manner as shown in FIG. 7.

In some embodiments, in order to improve the connection convenience among a plurality of fixed bottom plates 3, the rotary detent members 7 on two end sides 6 arranged opposite to each other are located on one diagonal of the elastic module unit 1, and the engagement members 8 on the two end sides arranged opposite to each other are located on the another diagonal of the elastic module unit 1, the rotation direction of the rotary detent members 7 are identical. Referring to FIGS. 6 and 7, the rotary detent members 7 of any two fixed bottom plates 3 can rotate in the same rotation direction to thus connect any two fixed bottom plates 3.

In other embodiments, the rotary detent members 7 may differ in rotation direction, i.e. the rotation direction of the rotary detent members 7 may be different.

In the elastic module unit 1 according to the present disclosure, the engagement member 8 may be of multiple types of structures. For example, for a structure type of engagement member 8, the engagement member 8 may be a rotary engagement member 7. In this way, rotary engagement members 7 of adjacent fixed bottom plates 3 can engage. For another example, for another structure type of engagement member 8, referring to FIGS. 2, 4 and 7, the engagement member 8 includes a snap-in post 9. When the rotary engagement member 7 engages the snap-in post 9, adjacent fixed bottom plates 3 are connected, and when the rotary engagement member 7 disengages from the snap-in post 9, the adjacent fixed bottom plates 3 are disconnected.

Figure 2:
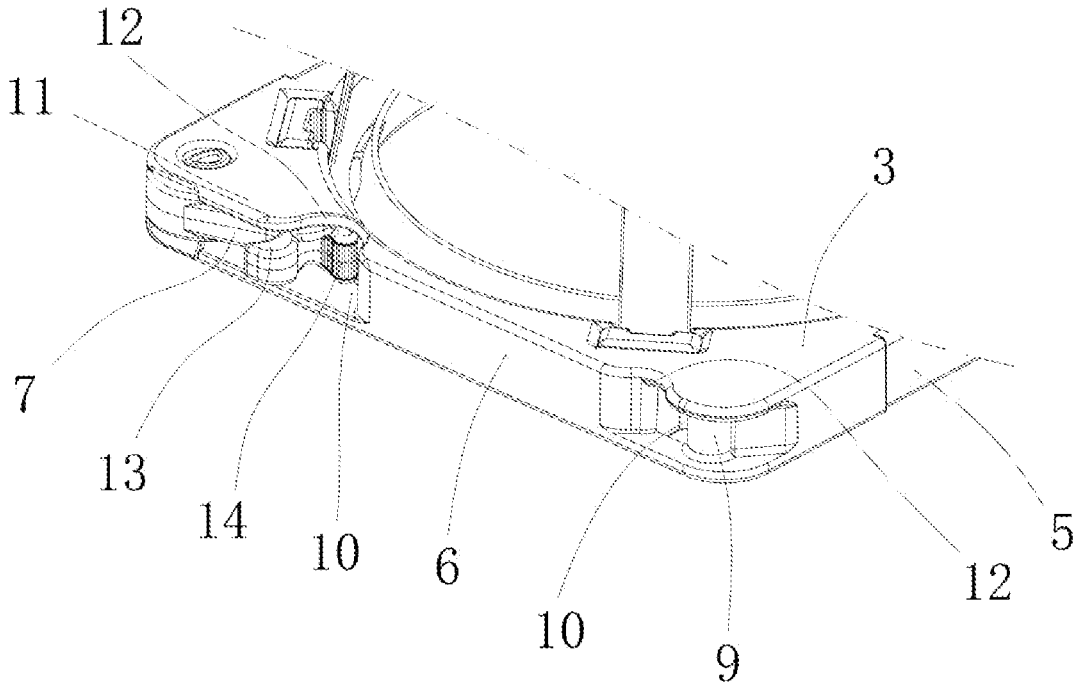
FIG. 2 is a schematic diagram of a partial structure of the elastic module unit in FIG. 1.
Figure 3:
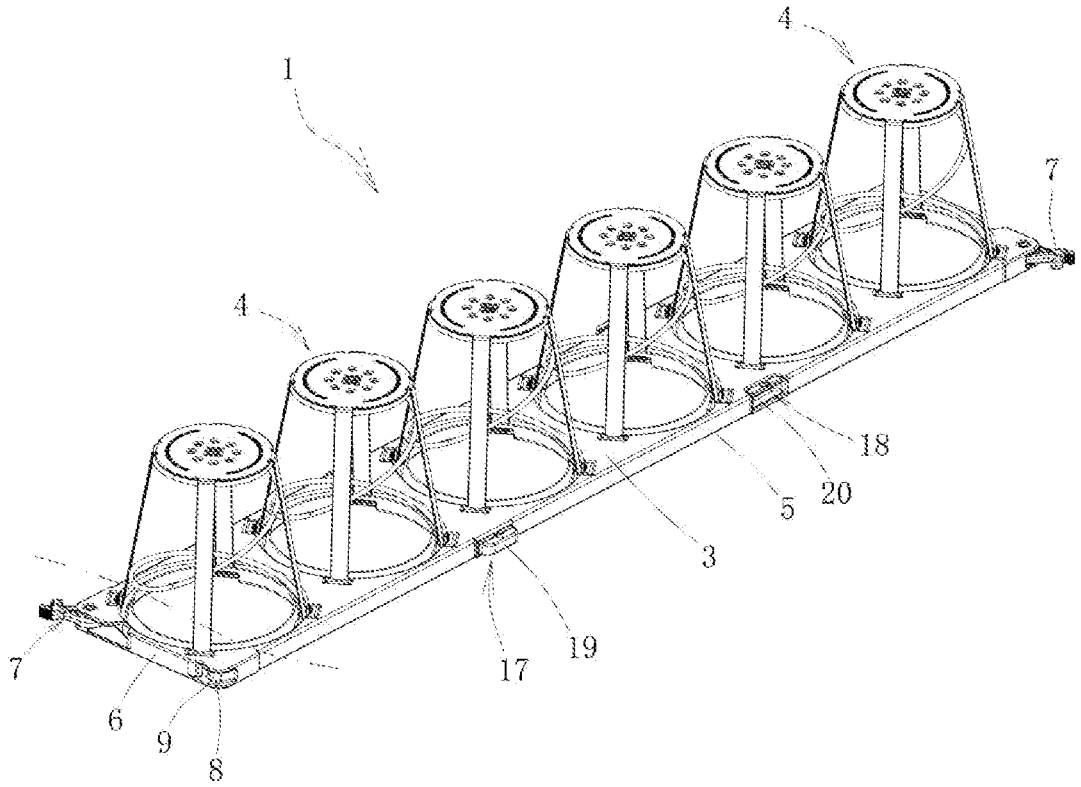
FIG. 3 is a schematic diagram of a three-dimensional structure where the rotary detent member of the elastic module unit in FIG. 1 is in an engagement position.
Figure 4:
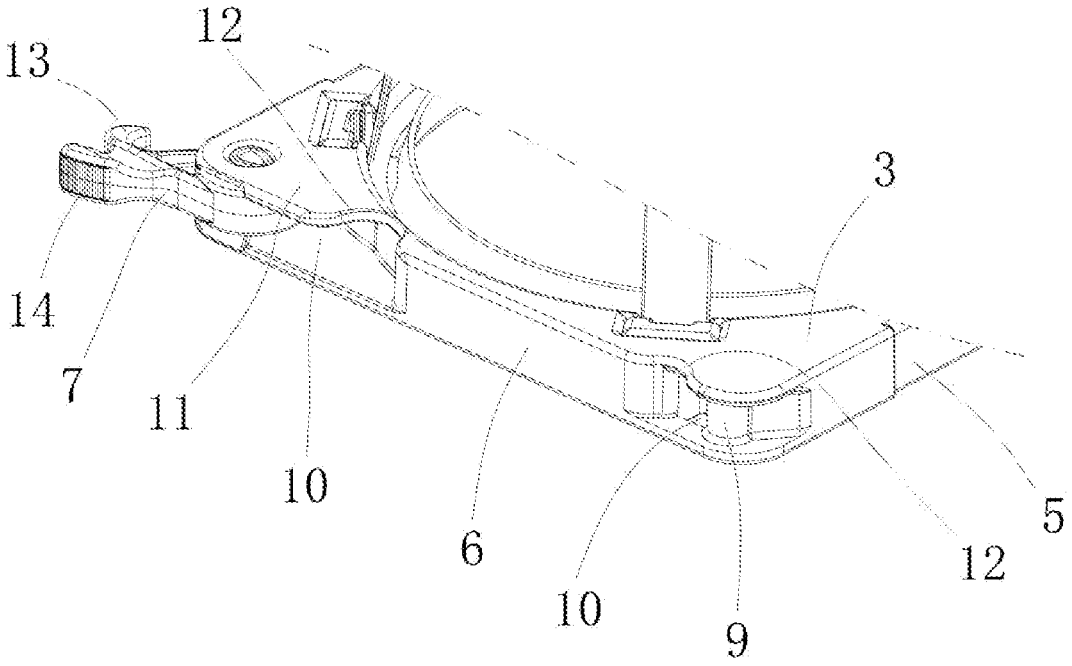
FIG. 4 is a schematic diagram of a partial structure of the elastic module unit in FIG. 3.

In some embodiments, referring to FIGS. 2, 4 and 6, a receiving groove 10 for receiving connectors is formed on a circumferential side surface of each corner of the fixed bottom plate 3. In the circumstance, the connectors, such as the rotary detent member 7 and the engagement member 8, may be located in the respective corresponding receiving grooves 10, to prevent most of the connectors from being exposed from the circumferential side surface of the fixed bottom plate 3.

In some embodiments, referring to FIGS. 2 and 4, the receiving groove 10 may include an upper groove wall 11, i.e., a receiving groove 10 extending transversely is formed on the circumferential side surface of the corner of the fixed bottom plate 3. At this time, an operating opening 12 enabling a user to apply a force to rotate the rotary detent member 7 is formed on the upper side groove wall 11. When connecting the respective fixed bottom plates, the operator can conveniently drive the rotary detent member 7 via the operating opening 12.

In some embodiments, referring to FIG. 6, the receiving groove 10 may not include an upper side wall 11, i.e., a receiving recess is formed in the corner of the upper surface of the fixed bottom plate 3, the receiving recess extends outwards to the circumferential side surface of the fixed bottom plate to be used as the receiving groove 10, and at this time, the connectors, such as a rotary detent member 7 and an engagement member 8, may be located in the respective corresponding receiving recess.

The rotary detent member 7 may be of multiple structures. For example, in some embodiments, referring to FIGS. 2, 4 and 7, the rotary detent member 7 comprises a detent hook 13 and a peg 14, the detent hook 13 is configured to be releasably snapped to an engagement member 8 of an adjacent elastic module unit 1. Wherein, the rotary detent member 7 has a storage position and an engagement position. In the storage position, the peg 14 is located within the receiving groove 10, and a part of the detent hook 13 extends laterally out from the receiving groove 10, so that an operator can conveniently operate the detent hook 13 via a part of the detent hook 13 to drive the rotary detent member 7 to rotate. In the engagement position, the detent hook 13 is located within the receiving groove of the adjacent elastic module unit, and a part of the peg 14 extends laterally out from the receiving groove 10 of the adjacent elastic module unit, so that an operator can conveniently operate the peg 14 via a part of the page 14 to drive the rotary detent member 7 to rotate.

In some embodiments, referring to FIG. 7, the rotary detent member 7 is configured to hook a connection rope 16 fixed on a pad layer 15 of the elastic pad 2. By hooking the connection rope 16 onto the rotary detent member 7, the elastic pad can form an elastic pad 2 without enclosed sides. Since no enclosed sides (that is sealed sidewall) are provided, the elastic pad 2 has a permeable or breathable inner structure having excellent ventilation performance, thus improving the breathability and comfort of the elastic pad 2. When it is required to store the elastic pad 2, the connection rope 16 and the rotary detent member 7 are released, and the respective fixed bottom plates 3 are disconnected from each other, enabling fast and convenient detachment for storage. This can effectively facilitate transportation of the elastic pad and reduce the storage space. In addition, the connection rope 16 may be a separate connection rope, or may be a part of a mesh rope of a mesh sidewall.

The rotary detent member 7 may be of multiple types. Irrespective of type, the rotary detent member 7 can be used as long as it can hook the connection rope 16. For example, in some embodiments, referring to FIG. 7, the rotary detent member 7 comprises a detent hook 13 and a peg 14, where the detent hook 13 is configured to be releasably snapped to the engagement member 8 of an adjacent elastic module unit 1. Wherein, the rotary detent member 7 includes a storage position and an engagement position. In the storage position, the peg 14 is located within the receiving groove 10, and the detent hook 13 is configured to hook the connection rope 16 (e.g. a part of the detent hook 13 extends laterally out from the receiving groove 10 to hook the connection rope 16). In the engagement position, the detent hook 13 is located within the receiving groove of the adjacent elastic module unit, and the detent hook 14 is configured to hook the connection rope 16 (e.g. a part of the peg 14 extends laterally out from the receiving groove 10 of the adjacent elastic module unit to hook the connection rope 16).

In some embodiments, in order to improve the splicing accuracy and convenience of the respective fixed bottom plates 3, referring to FIGS. 1, 3, 5 and 6, each of the splicing sides 5 is formed to have a pre-positioning structure, i.e. a pre-positioning structure is formed on each splicing side 5, the pre-positioning structure is configured to engage a pre-positioning structure on a splicing side 5 of a fixed bottom plate 3 of an adjacent elastic module unit 1. As such, when a plurality of elastic module units are spliced, the pre-positioning structures of the fixed bottom plates 3 of the adjacent elastic module units engage each other to pre-position the respective fixed bottom plates 3, and the rotary detent member 7 and the engagement member 8 of the adjacent fixed bottom plates 3 then engage each other.

The pre-positioning structure may be of multiple types. Irrespective of type, the pre-positioning structure can be used as long as it can pre-position the adjacent fixed bottom plates 3. For example, in some embodiments, referring to FIGS. 1 and 3, the pre-positioning structure comprises a first pre-positioning structure 17 and a second pre-positioning structure 18 spaced apart in the extending direction of the splicing side, where the second pre-positioning structure 18 is different from the first pre-positioning structure 17. Wherein, the first pre-positioning structure 17 is configured to engage with a second pre-positioning structure 18 of an adjacent elastic module unit 1, and the second pre-positioning structure 18 is configured to engage with a first pre-positioning structure 17 of an adjacent elastic module unit 1. With the engagement of the first pre-positioning structure 17 and the second pre-positioning structure 18 of adjacent fixed bottom plates, the pre-positioning balance of adjacent fixed bottom plates can be further improved.

In some embodiments, the second pre-positioning structure 18 is identical to the first pre-positioning structure 17.

Figure 5:
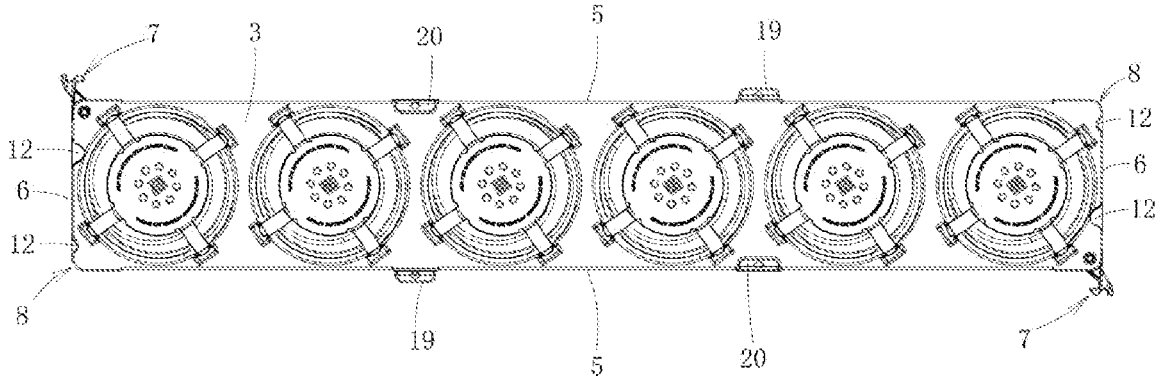
FIG. 5 is a top view of a structure of the elastic module unit in FIG. 3.

In some embodiments, referring to FIG. 5, the first pre-positioning structure 17 located at one side of the elastic module unit and the second pre-positioning structure 18 located at the other side are aligned with each other along a transverse direction of the elastic module unit (i.e., the height direction of FIG. 5, or the width direction of the fixed bottom plate 3 when the fixed bottom plate 3 is rectangular), the second pre-positioning structure 18 located at one side of the elastic module unit and the first pre-positioning structure 17 located at the other side are aligned with each other along the transverse direction of the elastic module unit. When adjacent fixed bottom plates 3 are spliced, it is only required to align the fixed bottom plates 3 with each other, to further improve the convenience in pre-positioning engagement.

The first pre-positioning structure 17 and the second pre-positioning structure 18 may be engageable hook and groove structures, respectively. Alternatively, referring to FIGS. 1, 3 and 5, the first pre-positioning structure 17 is a pre-positioning bump 19, and the second pre-positioning structure 18 is a pre-positioning groove 20. When adjacent fixed bottom plates 3 are spliced, it is only required to align the fixed bottom plates 3 with each other, the pre-positioning bump 19 is then embedded into the pre-positioning groove 20 upon pushing the fixed bottom plates 3, and the adjacent fixed bottom plates 3 are pre-positioned and engaged.

In a second aspect, the present disclosure provides an elastic pad 2. Referring to FIGS. 8-15, the elastic pad 2 includes a plurality of the elastic module units 1 any described above according to the first aspect, and a pad layer 15. Wherein, a plurality of fixed bottom plates 3 are spliced together by the engagement of the rotary detent member 7 and the engagement member 8, so that a plurality of elastic module units 1 can be assembled into an elastic support layer 21; the pad layer 15 is laid on a plurality of elastic modules 4 of the elastic support layer 21.

As described above, the plurality of fixed bottom plates 3 can be spliced together by engagement of the rotary detent member 7 and the engagement member 8, so that the plurality of elastic module units 1 can be assembled into the elastic support layer 21 of the elastic pad 2. Therefore, this can remarkably improve the convenience in assembling the elastic pad 2, and can facilitate detachment for storage, thereby effectively reducing the occupied space when storing the elastic pad.

Figure 9:
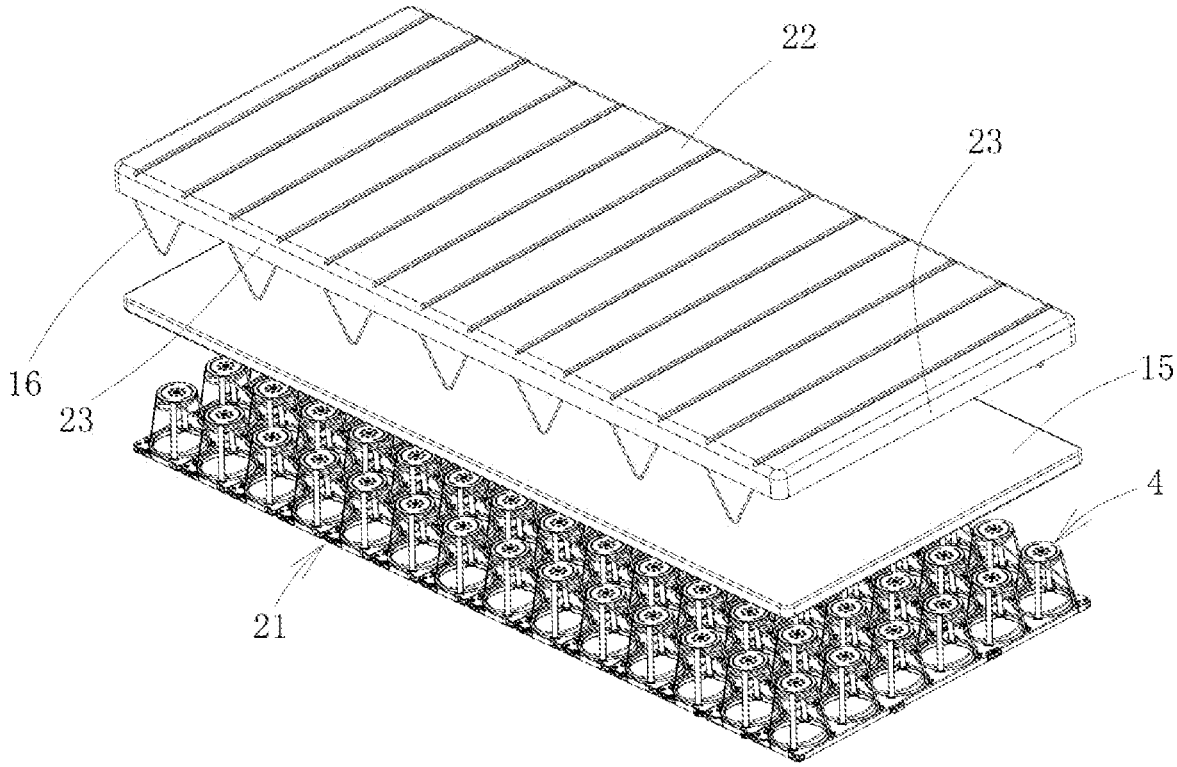
FIG. 9 is an exploded view exemplarily illustrating a first type of elastic pad according to the present disclosure, where the elastic support layer shown in FIG. 8 is illustrated.
Figure 10:
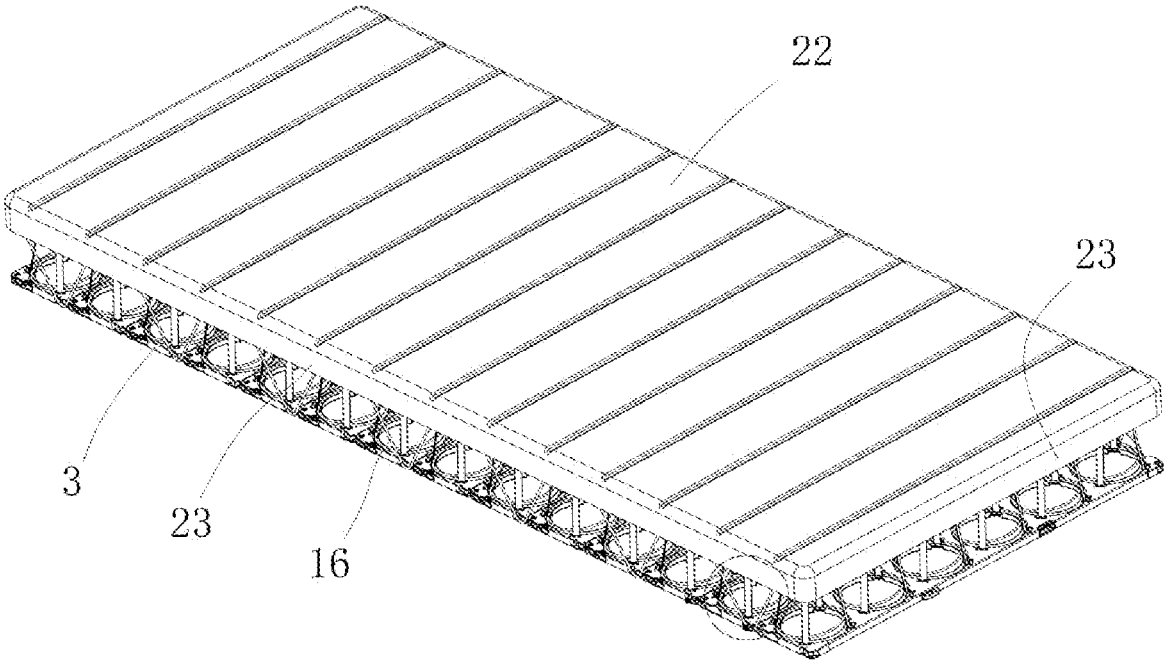
FIG. 10 is a schematic diagram of a three-dimensional structure where the elastic pad in FIG. 9 is in an assembled state.
Figure 13:
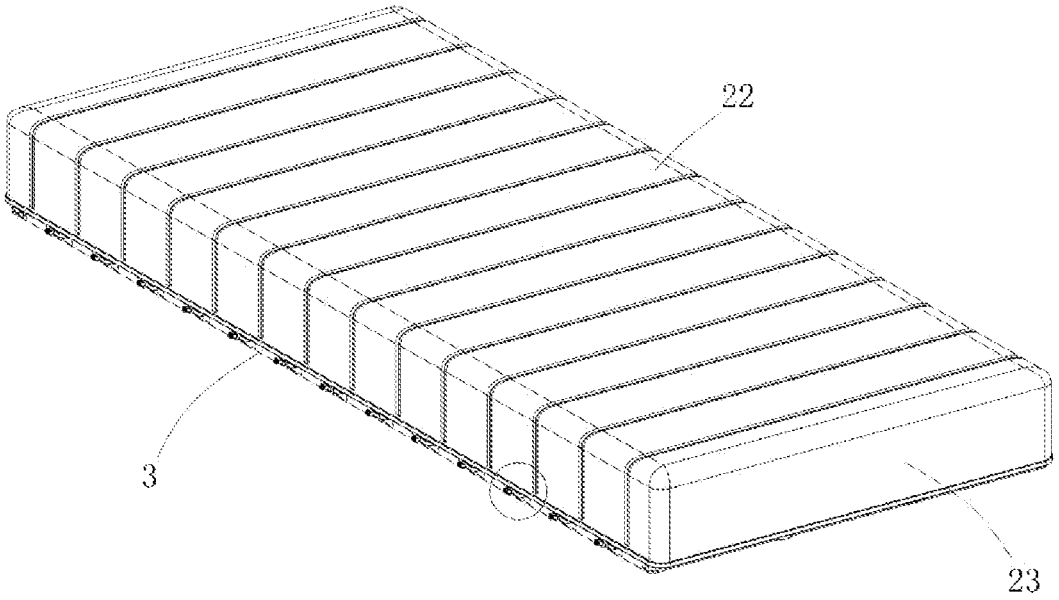
FIG. 13 is a schematic view of a three-dimensional structure where the elastic pad in FIG. 12 is in an assembled stated.
Figure 15:
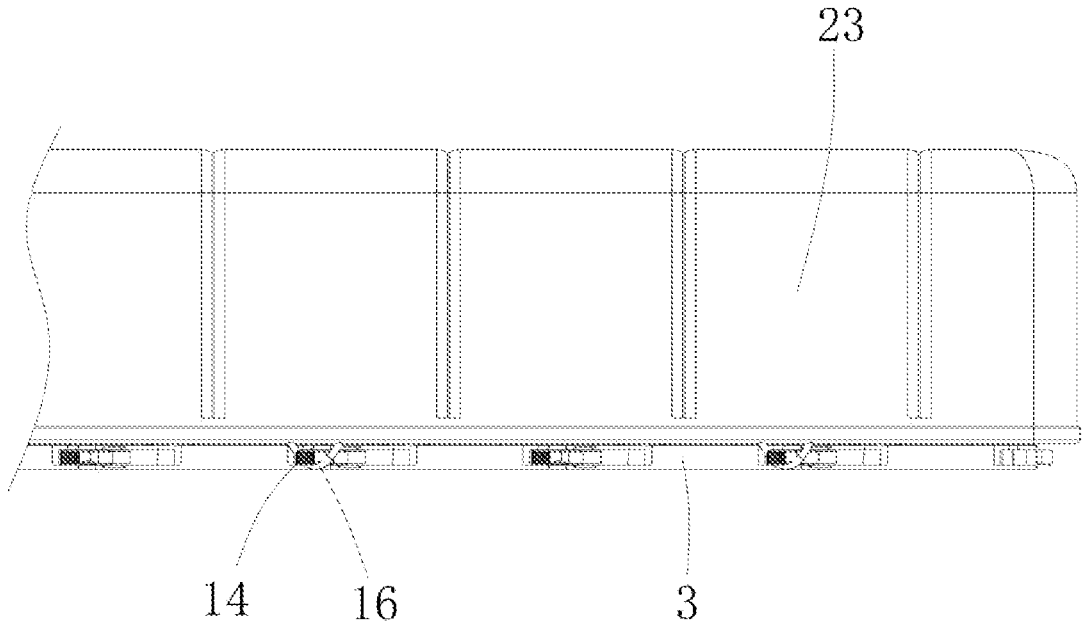
FIG. 15 is a schematic diagram of a partial structure of the elastic pad in FIG. 13.

Referring to FIGS. 9 and 10 as well as FIGS. 1, 13 and 15, the elastic pad 2 further includes a cover 22, wherein the cover 22 covers the pad layer 15 and connected with the fixed bottom plates spliced together via an edge connection structure which enables the elastic pad 2 to form an elastic pad without enclosed sides surrounding the cover. Since the edge connection structure makes it possible to form the elastic pad 2 without enclosed sides, the elastic pad 2 has a permeable or breathable inner structure having excellent ventilation performance, thereby improving the permeability or breathability of the elastic pad 2. When it is required to store the elastic pad 2, the edge connection structure and the fixed bottom plates are released and the respective fixed bottom plates 3 are disengaged from one another, to thus complete fast and convenient detachment for storage. This can effectively facilitate transportation of the elastic pad and reduce the storage space.

The edge connection structure may be of multiple structures. Irrespective of the type, the edge connection structure can be applied as long as it can connect the fixed bottom plates and the cover 22, making it possible to form an elastic pad without enclosed sides. For example, for a type of the edge connection structure, the edge connection structure may be a mesh body. In the circumstance, through a plurality of meshes of the mesh body, the breathability of the elastic pad 2 can be improved. For another type of the edge connection structure, referring to FIGS. 11 and 14, the edge connection structure includes a connection rope 16. For example, the connection rope 16 may be connected at the edge of the cover 22. For instance, the connection rope 16 is connected on the stop edge 23 as will be described below. Accordingly, the connection rope 16 only needs to be connected with the fixed bottom plates 3. In addition, the connection rope 16 may be a plurality of rope loops independent of each other arranged at intervals, or may extend continuously in a wavy manner.

Figure 11:
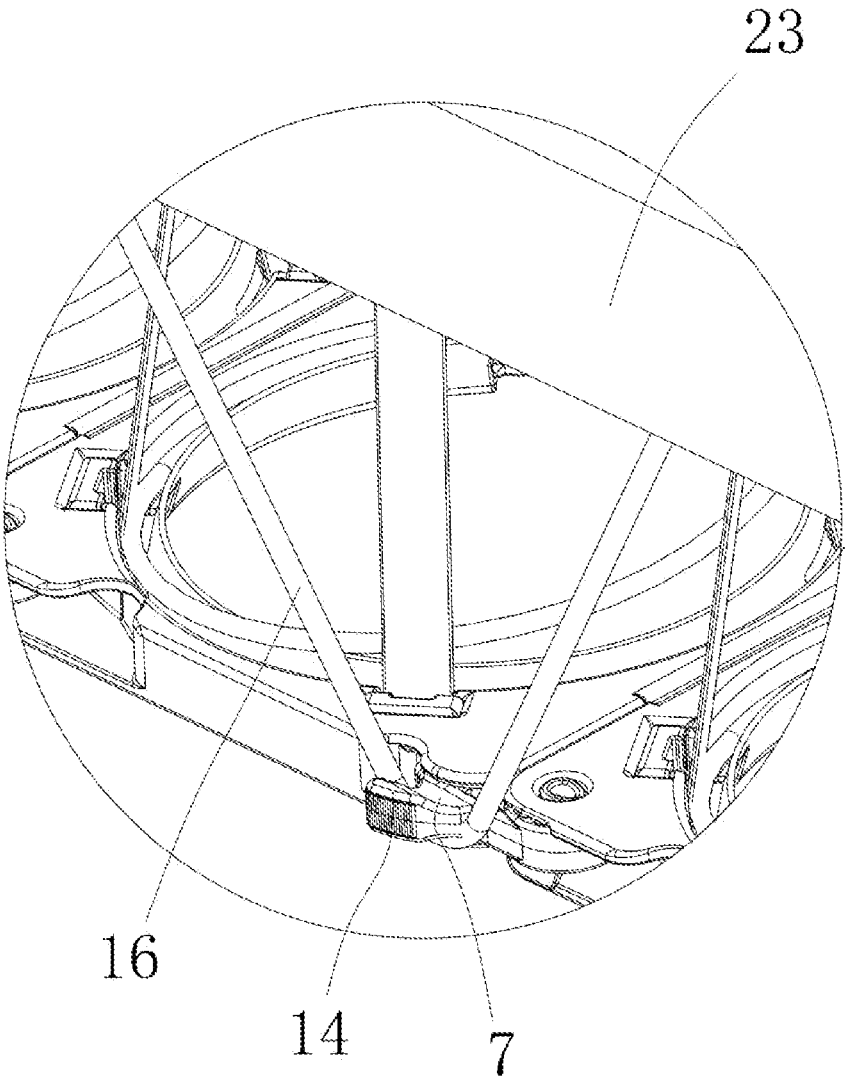
FIG. 11 is a schematic diagram of an enlarged structure of a circled portion in FIG. 10.
Figure 14:
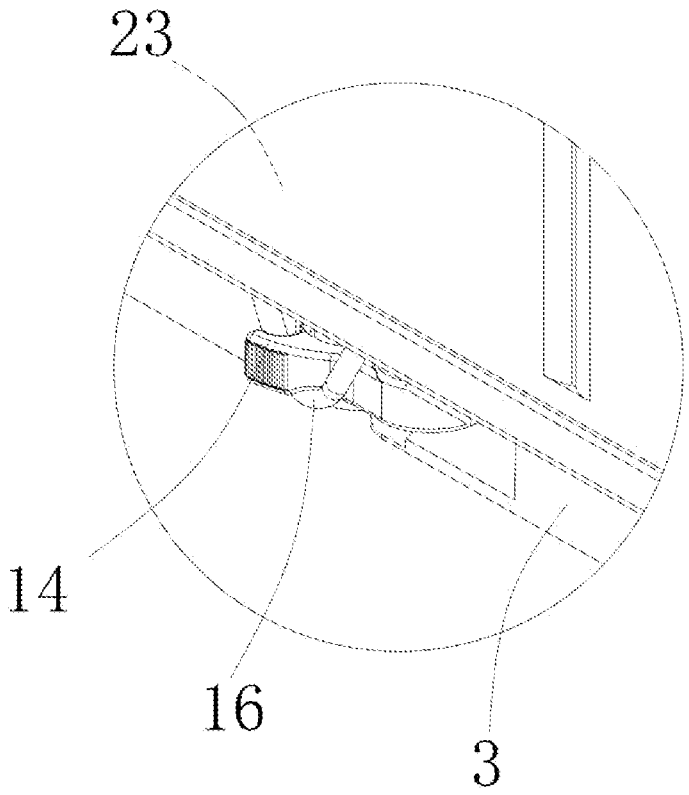
FIG. 14 is a schematic view of an enlarged structure of a circled portion in FIG. 13.

In some embodiments, referring to FIGS. 11 and 14, the rotary detent member 7 includes a detent hook 13 and a peg 14, where the detent hook 13 of the rotary detent member 7 in the storage position can releasably hook a corresponding connection rope 16, and the peg 14 of the rotary detent member 7 in the engaged position can releasably hook a corresponding connection rope 16. As such, the rotary detent member 7 can not only connect the respective fixed bottom plates 3, but also can facilitate hooking of the connection rope 16.

Figure 12:
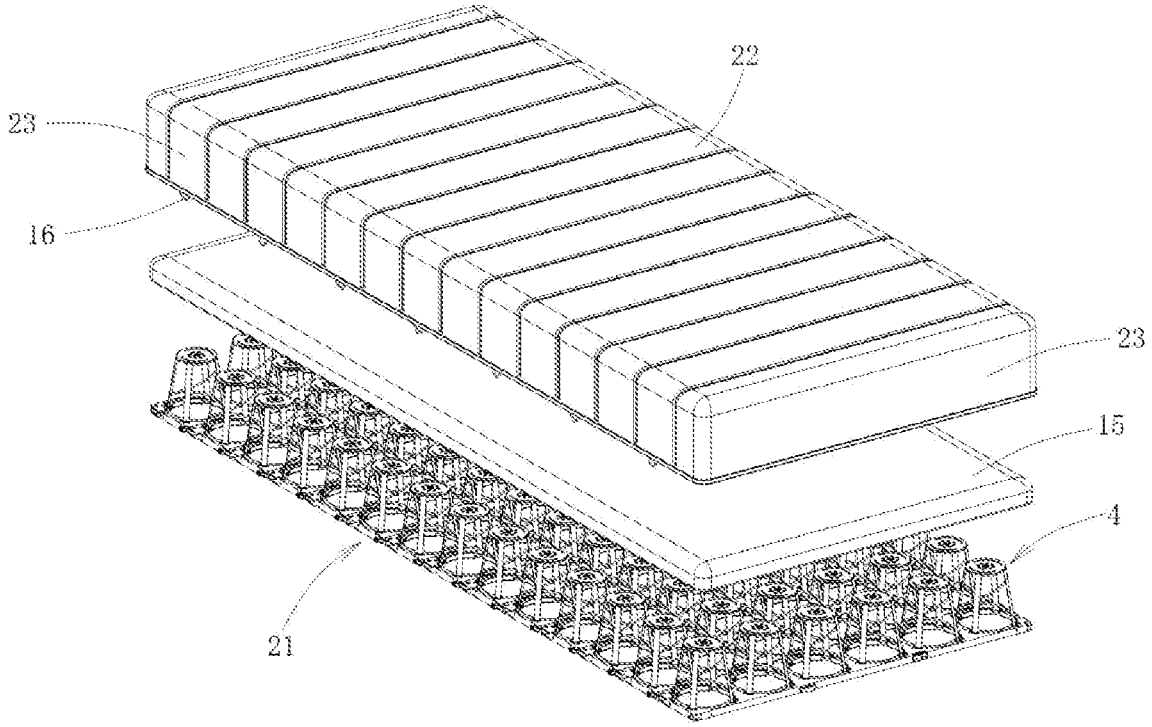
FIG. 12 is an exploded view exemplarily illustrating a second type of elastic pad according to the present disclosure, where the elastic support layer shown in FIG. 8 is illustrated.

In some embodiments, referring to FIGS. 9-11 as well as FIGS. 12-14, at least two sides of the cover arranged opposite to each other are provided with stop edges 23 facing the fixed bottom plates 3. At least two stop edges arranged opposite to each other (e.g. stop edges in the length direction of the elastic pad) in the stop edges 23 are connected with the spliced fixed bottom plates via the edge connection structure. For example, the connection rope 16 is hooked to the detent hook 13 and the peg 14 of the rotary detent member 7. As the tightening effect of the edge connection structure, the stop edges 23 may be in a tensioned state extending downwards to abut against and stop the outermost elastic module 4. This can effectively prevent movement of the outermost elastic module 4 in the transverse direction of the elastic pad, to thus improve the stability of the elastic modules.

The stop edge 23 may be kept a predetermined interval from the fixed bottom plate 3. For example, referring to FIGS. 9-11, there is a great predetermined interval between the stop edge 23 and the fixed bottom plate 3. For another example, referring to FIGS. 12-14, the stop edge 23 extends to a position where is close to the fixed bottom plate 3 and is retained a predetermined interval from the fixed bottom plate 3, so that the stop edge 23 shields the elastic module 4. Since the elastic module 4 is shielded by the stop edge 23, a more pleasing appearance of the side of the elastic pad 2 can be improved.

In addition, the elastic pad 2 can be applied as desired. For example, the elastic pad 2 may be used as an outdoor pad or an indoor pad. For example, the elastic pad 2 may be used as an elastic mattress, a sofa cushion, a chair cushion and a bench cushion.

In a third aspect, the present disclosure provides a furniture including any elastic pad 2 as described above in the second aspect. In the case, as stated above, with the elastic pad 2, the furniture exhibits excellent performance in stability and comfort while the furniture cost can be reduced, thus improving the overall quality.

The scope of protection of the present disclosure is defined only by the appended claims. Given the teaching of the present disclosure, those skilled in the art could easily envision using alternative structures of those disclosed herein as feasible alternative embodiments, and combining the embodiments disclosed herein to form new embodiments, which should all fall into the scope defined by the appended claims.

I claim:

1. An elastic module unit being configured to be assembled into an elastic pad (2), the elastic module unit (1) comprises a fixed bottom plate (3) and a plurality of elastic modules (4) disposed on the fixed bottom plate (3), the fixed bottom plate (3) comprises splicing sides (5) arranged opposite to each other and end sides (6) arranged opposite to each other, and each of the end sides (6) comprises a plurality of connectors, the plurality of connectors comprise at least one of a rotary detent member (7) and an engagement member (8), wherein, the rotary detent member (7) is configured to swing about a pivot axis so that it releasably engages an engagement member (8) of an adjacent elastic module unit (1); and the engagement member (8) is configured to releasably engage a rotary detent member (7) of an adjacent elastic module unit (1).

2. The elastic module unit of claim 1, wherein one of the plurality of connectors is disposed at a corner of each of the end sides (6).

3. The elastic module unit of claim 1, wherein each of the end sides (6) is provided with the rotary detent member (7) and the engagement member (8).

4. The elastic module unit of claim 3, wherein the rotary detent members (7) on two end sides (6) arranged opposite to each other are located on one diagonal of the elastic module unit (1), while the engagement members (8) on the two end sides (6) arranged opposite to each other are located on the another diagonal of the elastic module unit (1), and the rotary detent members (7) are rotatable in the same direction.

5. The elastic module unit of claim 1, wherein the engagement member (8) comprises a snap-in post (9).

6. The elastic module unit of claim 1, wherein a receiving groove (10) configured to receive the connectors is formed on a circumferential side surface at each corner of the fixed bottom plate (3).

7. The elastic module unit of claim 6, wherein an operating opening (12) for enabling a user to apply a force to rotate the rotary detent member (7) is formed on an upper groove wall (11) of each receiving groove (10).

8. The elastic module unit of claim 6, wherein the rotary detent member (7) comprises a detent hook (13) and a peg (14), the detent hook (13) being configured to be releasably snapped to the engagement member (8) of the adjacent elastic module unit (1), wherein the rotary engagement member (7) has a storage position where the peg (14) is located within the receiving groove (10) and a part of the detent hook (13) extends laterally from the receiving groove (10), and an engagement position where the detent hook (13) is located in the receiving groove of the adjacent elastic module unit and a part of the peg (14) extends laterally from the receiving groove (10) of the adjacent elastic module unit.

9. The elastic module unit of claim 1, wherein the rotary detent member (7) is configured to hook a connection rope (16) fixed on a pad layer (15) of the elastic pad (2).

10. The elastic module unit of claim 9, wherein the rotary detent member (7) comprises a detent hook (13) and a peg (14), the detent hook (13) being configured to be releasably snapped to the engagement member (8) of the adjacent elastic module unit (1), wherein the rotary detent member (7) has a storage position where the peg (14) is located within a receiving groove (10) and the detent hook (13) is configured to hook the connection rope (16), and an engagement position where the detent hook (13) is located within the receiving groove of the adjacent elastic module unit and the peg (14) is configured to hook the connection rope (16).

11. The elastic module unit of claim 1 wherein each of the splicing sides (5) is formed to have a pre-positioning structure, which is configured to engage with a pre-positioning structure formed on a splicing side (5) of a fixed bottom plate (3) of an adjacent elastic module unit (1).

12. The elastic module unit of claim 11, wherein the pre-positioning structure comprises a first pre-positioning structure (17) and a second pre-positioning structure (18) arranged at an interval in an extending direction of the splicing sides, the second pre-positioning structure (18) being different from the first pre-positioning structure (17);

wherein the first pre-positioning structure (17) is configured to engage with a second pre-positioning structure (18) of an adjacent elastic module unit (1), and the second pre-positioning structure (18) is configured to engage with a first pre-positioning structure (17) of an adjacent elastic module unit (1).

13. The elastic module unit of claim 12, wherein the first pre-positioning structure (17) located at one side of the elastic module unit and the second pre-positioning structure (18) located at the other side are aligned with each other along a transverse direction of the elastic module unit, and the second pre-positioning structure (18) located at one side of the elastic module unit and the first pre-positioning structure (17) located at the other side are aligned with each other along the transverse direction of the elastic module unit.

14. The elastic module unit of claim 13, wherein the first pre-positioning structure (17) is a pre-positioning bump (19), and the second pre-positioning structure (18) is a pre-positioning groove (20).

15. An elastic pad comprising:

a plurality of elastic module units (1) according to claim 1, a plurality of the fixed bottom plates (3) being spliced together by engagement of the rotary detent member (7) and the engagement member (8) so that the plurality of the elastic module units (1) are assembled into an elastic support layer (21); and a pad layer (15) laid on a plurality of the elastic modules (4) of the elastic support layer (21).

16. The elastic pad of claim 15, wherein the elastic pad (2) further comprises a cover (22), wherein the cover (22) covers the pad layer (15) and is connected with the spliced fixed bottom plates via an edge connection structure which enables the elastic pad (2) to form an elastic pad without an enclosed side surrounding the cover (22).

17. The elastic pad of claim 16, wherein the edge connection structure comprises a connection rope (16), and when the rotary detent member (7) comprises a detent hook (13) and a peg (14), the detent hook (13) of the rotary detent member (7) in a storage position releasably hooks a corresponding connection rope (16), and the peg (14) of the rotary detent member (7) in an engagement position releasably hooks a corresponding connection rope (16).

18. The elastic pad of claim 16, wherein at least two sides of the cover (22) arranged opposite to each other are provided with stop edges (23) facing the fixed bottom plates (3), and at least two stop edges arranged opposite to each other in the stop edges (23) are connected with the spliced fixed bottom plates via the edge connection structure.

19. The elastic pad of claim 18, wherein the stop edge (23) extends towards a perimeter of the elastic pad to cover sides of the elastic pad.

20. The elastic pad of claim 15 wherein the elastic pad is used as an elastic mattress.

21. A piece of furniture comprising the elastic pad (2) according to claim 15.

22. An elastic module unit comprising:

a bottom plate having first, second, third and fourth corners;

a first rotary member pivotally attached to the first corner of the bottom plate;

a second rotary member pivotally attached to the third corner of the bottom plate;

a first engagement member at the second corner of the bottom plate;

a second engagement member at the fourth corner of the bottom plate;

each rotary member configured to releasably engage an engagement member of an adjacent second elastic module unit; and a plurality of elastic modules on the bottom plate.

* * * * *